US005943711A

United States Patent [19]

Loizeaux et al.

[11] Patent Number: 5,943,711

[45] Date of Patent: Aug. 31, 1999

[54] GATLING JET

[75] Inventors: Phillip Dudley Loizeaux, San Marcos; Thai Ton, Lemon Grove, both of Calif.

[73] Assignee: Watkins Manufacturing Corp., Vista, Calif.

[21] Appl. No.: 08/978,467

[22] Filed: Nov. 25, 1997

Related U.S. Application Data

[63] Continuation of application No. 08/747,545, Nov. 12, 1996, Pat. No. 5,742,953.

[51] Int. Cl.[6] ..... A61H 33/02

[52] U.S. Cl. ..... 4/541.6; 4/541.4; 4/492; 239/428.5

[58] Field of Search ..... 4/492, 541.1, 541.6; 239/428.5, 558, 407

[56] References Cited

U.S. PATENT DOCUMENTS

| | | | |
|---|---|---|---|
| 2,998,928 | 9/1961 | Aghnides . | |
| 3,330,486 | 7/1967 | Semple . | |
| 3,745,994 | 7/1973 | Kane . | |
| 4,135,670 | 1/1979 | Sugimoto | 239/428.5 |
| 4,416,030 | 11/1983 | Reynoso | 4/541.6 |
| 4,586,204 | 5/1986 | Daniels . | |
| 4,985,943 | 1/1991 | Tobias et al. | 4/541.6 |
| 5,014,372 | 5/1991 | Thrasher et al. . | |
| 5,054,474 | 10/1991 | Jacob, et al. | 4/541.6 |
| 5,111,994 | 5/1992 | Gonzalez . | |
| 5,220,695 | 6/1993 | Henkin et al. | 4/541.6 |
| 5,271,561 | 12/1993 | Tobias et al. | 4/541.6 |
| 5,291,621 | 3/1994 | Mathis . | |
| 5,316,216 | 5/1994 | Cammack et al. . | |
| 5,462,230 | 10/1995 | Van Ouwerkerk | 239/428.5 |
| 5,495,627 | 3/1996 | Leaverton et al. . | |
| 5,657,496 | 8/1997 | Corb et al. . | |

FOREIGN PATENT DOCUMENTS

| | | | |
|---|---|---|---|
| 6764290 | 4/1991 | Australia . | |
| 2209507 | 9/1973 | Germany | 4/492 |
| 8802541 | 8/1989 | Netherlands | 4/541.6 |

*Primary Examiner*—Charles R. Eloshway
*Attorney, Agent, or Firm*—Price, Gess & Ubell

[57] ABSTRACT

A jet for use in spas and hydrotherapeutic reservoirs having a first set of nozzles aligned in a plane at the water entrance side of the jet and a second set of nozzles aligned one-to-one with the first set of nozzles at the water exit side of the jet. A chamber separates the two sets of nozzles and includes a slot which is used to introduce air into the fluid stream. The amount of air introduced into the chamber is controlled by the user by rotating the jet within its housing from a maximum air intake position to a "no-air" intake position, air being introduced through a slot surrounded by a rectangular seal structure. A housing is provided to mount the jet within the wall of a spa comprising a rear wall mounting, an end cap, and a front wall mounting. Water is introduced to the multiple jet structure via a single horizontal water inlet. The servicing of multiple jets by the single water inlet and air line improves plumbing reliability and further reduces labor by minimizing the number of plumbing joints.

11 Claims, 5 Drawing Sheets

GATLING JET

This is a continuation of prior application Ser. No. 08/747,545, filed on Nov. 12, 1996 now U.S. Pat. No. 5,742,953.

BACKGROUND OF THE INVENTION

1. Field of the Invention

The present invention relates generally to hydrotherapy reservoirs such as spas, whirlpools, and baths and, more specifically, to a hydrotherapy jet which can be mounted to a hydrotherapy reservoir and supplied with a pressurized source of heated water and air to produce multiple streams of water and air which can be adjusted to suit the user's tastes.

2. Description of Related Art

The soothing and rehabilitating effects of spas have been known to the medical profession and those concerned with field of athletics for many years, and in more recent years their popularity has spread to homes as well. For brevity the term "spa" from here on shall refer generally to a family of reservoirs including whirlpools and baths which are suited for relaxing and soothing sore muscles and releasing tension.

The expansion of the spa market into the home has led to the development of spa models which appeal to the tastes of a greater variety of people. One of the primary factors in the overall enjoyment and preference in a spa is the type, number, and location of the jets which expel the heated water and create the hydrotherapy effect for which the spa is known. There have been a significant number of nozzles proposed which are designed to produce the most versatile stream with the simplest design, such as nozzles which allow the user to adjust the flow rate of the stream, nozzles which can be adjusted to allow air to be mixed with the stream of hot water, and nozzles which rotate to produce a pulsating effect. The prior art still lacks a nozzle which is simple in design and yet capable of producing the effects of the present invention.

The nozzle assembly of Thrasher, U.S. Pat. No. 5,014,372, includes a perpendicular water inlet and a perpendicular air inlet which are allowed to mix in a chamber, and the combination of air and water is expelled through a nozzle exit which is designed to impart a rotation on the nozzle head. The nozzle head rotates in the assembly within a cage, and includes a brake washer and compression spring which can be used to manually adjust the rotational velocity of the nozzle. The nozzle can also be manually turned in a limited range to vary the alignment of the water and air inlets, and thereby vary the amount of water and air which is entering the nozzle, although the composition of air and water cannot be set by the user.

The nozzle assembly of Mathis, U.S. Pat. No. 5,291,621, includes a nozzle head with a freely rotating rotor disposed therein which has outlets designed to impart a rotation on the rotor. The nozzle assembly has a control cylinder which controls the amount of air and water entering the nozzle assembly and which is manipulated by pressing the nozzle head against the axial thrust created by the nozzle outlet to engage the nozzle head with the control cylinder, and rotating the cylinder to the preferred position. By adjusting the flow rate the nozzle automatically adjusts the speed of the rotor, but the nozzle cannot be used to adjust the composition of air and water released from the exit.

Leaverton et al., U.S. Pat. No. 5,495,627 discloses a jet valve which can be rotated from a full flow position to a zero flow position to allow the user to determine the exact flow rate desired, and also provides for an open-shut aeration valve. While the jet valve allows for the option of aeration of the flow or no aeration, the composition of the air cannot be adjusted. The nozzle assembly is mounted in a ball-and-socket type joint which can be manipulated to direct the stream of water and air in a limited range of directions.

It should be noted that the art lacks a jet which can be adjusted to control the composition of air in the stream independent of the water flow control. Leaverton does not permit individual adjustment of the air independent of the water flow, but rather provides an open or shut valve. The Mathis nozzle has the control of air tied to the control of the water, and so no independent control of the air is possible. The art thus lacks a jet wherein the control of air introduced into the jet stream is controllable within a spectrum from a maximum air intake position to a "no-air" intake position. The art further lacks an effective air intake sealing structure and the capability to plumb multiple jets from a single water inlet.

OBJECTS AND SUMMARY OF THE INVENTION

It is an object of the invention to provide an improved spa jet;

It is another object of the present invention to provide a jet structure which provides multiple streams of water and air;

It is another object of the present invention to provide a spa jet with adjustable air control;

It is yet a further object of the present invention to provide a nozzle with a rotatable face plate which can be used to adjust the amount of air intake of the nozzle;

It is still a further object of the present invention to provide a nozzle whereby a plurality of jets can be plumbed as a single jet; and It is a still further object to provide a jet structure providing multiple jet streams and yet is plumbed as a single jet.

In accordance with one aspect of the present invention, a jet is provided with a first set of nozzles located at the water entrance side of the jet and a second set of nozzles. The second set of nozzles is aligned with the first set of nozzles in a one-to-one relationship and spaced apart from the first set of nozzles by a chamber. The chamber includes a slot or orifice whereby air can be introduced or "entrained" into the stream of water between the first and second set of nozzles, and which facilities user control of the amount of air introduced. The multiple jet array gives rise to the appellation "Gatling jet."

In a preferred embodiment, a unitary jet comprising a body, an orifice cap, a body cap, and a face plate is provided. The jet mounts in a housing comprising a rear wall mounting, a rear wall mounting cap, and a front wall mounting. The jet is rotatable within the housing, and rotation of the jet adjusts the amount of air introduced into the fluid stream. The jet and housing cooperate to limit rotation of the jet between a maximum air intake position and a "no-air" intake position.

Other aspects of the invention include a novel sealing structure about the air intake and introduction of water to a multiple jet structure via a single horizontal rear water inlet. The servicing of multiple jets via one air line and one water line improves plumbing reliability and reduces labor by minimizing the number of plumbing joints. Various numbers of jets and various arrays and positioning of the multiple jets may be provided. An enhanced feel like fingers dispersed over an area of the user's body may be achieved.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to a Gatling-type jet for use in spas and the like.

Figure 1:
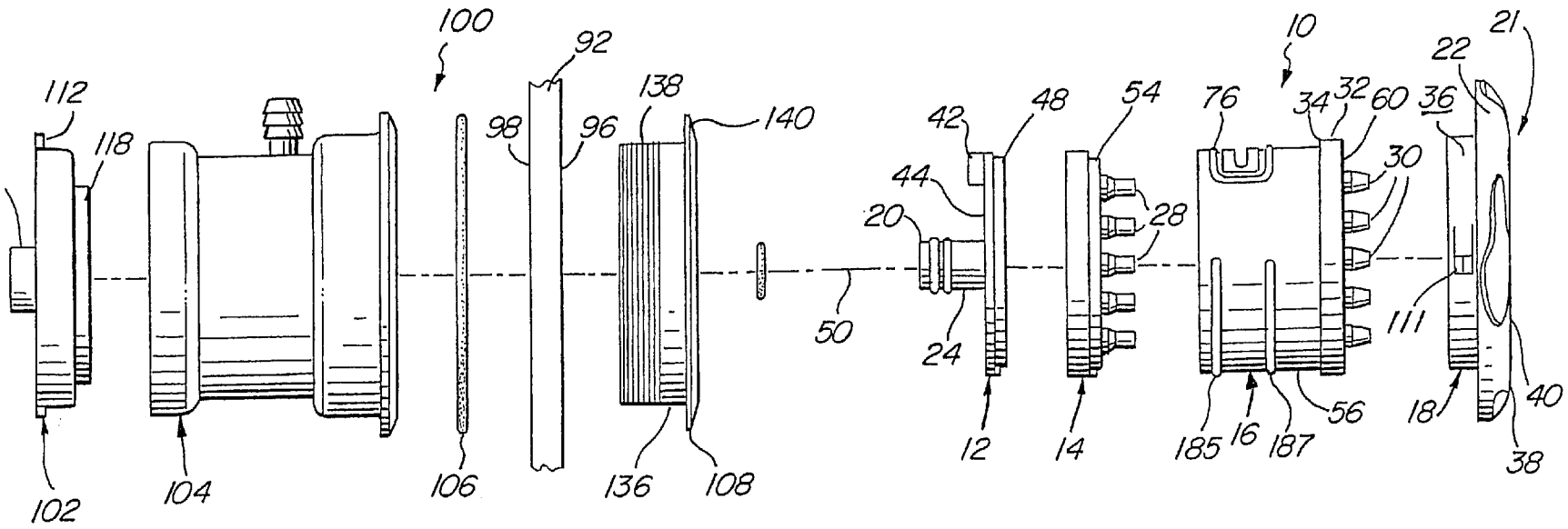
FIG. 1 is an exploded view of the housing structure and the jet of a preferred embodiment.

Turning now to FIG. 1, the elements of a preferred embodiment of a hydrotherapeutic jet 10 and mounting structure 100 are shown. The mounting structure 100 houses the jet 10 and secures the jet to a wall 92, such as a wall of a hydrotherapeutic reservoir. The mounting structure, denoted generally as 100 comprises a rear wall mounting cap 102, a rear wall mounting 104, and a front wall mounting 108. In a preferred embodiment, an O-ring 106 is included between the rear wall mounting 104 and the wall 92.

Figure 2:
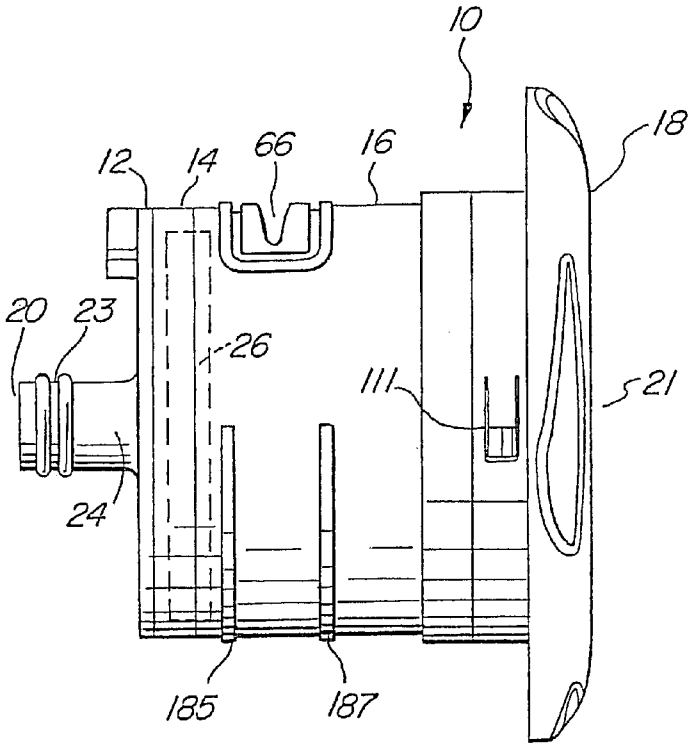
FIG. 2 is a side view of the assembled jet of the preferred embodiment.

The jet 10 comprises a jet body cap 12, a jet orifice cap 14, a jet body 16, and a face plate 18. As shown in FIG. 2, a reservoir 26 is formed in between the jet body cap 12 and the jet orifice cap 14 when the two components are connected. In the preferred embodiment, the jet body cap 12, the jet orifice cap 14, the jet body 16, and the face plate 18 are permanently connected and sealed using sonic welding, an adhesive or cement to form a unitary jet structure 10 as shown in FIG. 2. Each individual component of the jet structure 10 will now be described in detail.

With reference to FIGS. 1 and 2, the jet body cap 12 forms a first end 20 of the jet 10 and includes a tubular inlet 24 on which is formed an O-ring seat 23. The tubular inlet 24 is typically connected to a supply of pressurized heated water. The jet orifice cap 14 mates with the jet body cap 12, and the heated water entering the tubular inlet 24 fills the reservoir 26 between the two components. The jet orifice cap 14 is fixed to the jet body 16, and the jet body 16 is in fluid communication with the reservoir 26 through a plurality of rear nozzles 28 (FIG. 1). Once the reservoir 26 is filled with water, the fluid pressure increases forcing the fluid through the rear nozzles 28 into the jet body 16.

At the opposite end 21 of the jet body 16 is a second plurality of nozzles 30, arranged in a plane and aligned with the first plurality of nozzles 28 in a one-to-one relationship. That is, each nozzle 28 has a corresponding nozzle 30 which is aligned, preferably along a common axis, such that fluid expelled through a nozzle 28 will form a stream which is directed into a corresponding nozzle 30. The jet body 16 includes an outer ridge 32 having a slightly larger circumference than the jet body 16, which forms a step 34 on the jet body exterior which positions the jet body 16 inside the rear mounting 104. The face plate 18 comprises a cylindrical portion 36 terminating in a beveled rim 38. When mounted to the jet body 16, the face plate 18 extends beyond the nozzles 30 at an exit plane 40 in order to protect a user from contact with the nozzles 30.

Figure 3:
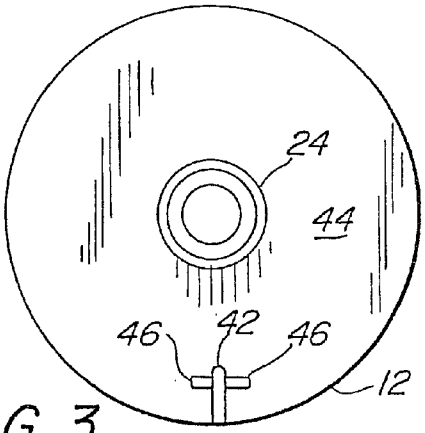
FIG. 3 is a front view of the jet body cap.
Figure 4:
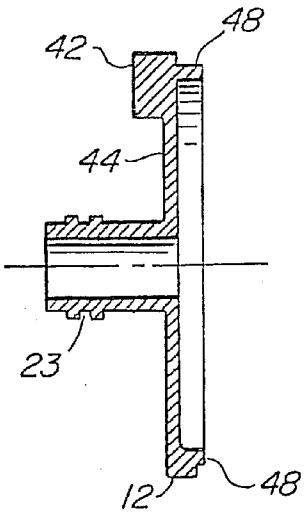
FIG. 4 is a cross-sectional view of the jet body cap.

FIGS. 3 and 4 show the jet body cap 12 in more detail. A toe 42 projects perpendicularly from a generally vertical outer surface 44 of the jet body cap 12. As will be described below, the toe 42 is used to limit the rotation of the jet body 16 between a maximum air intake position and a "no-air" intake position. The tubular inlet 24 is concentric with the jet body cap 12 and provides the entrance for the fluid to the jet. It can further be seen that the toe 42 includes webs 46 which extend perpendicular to the toe 42 and provide additional support for the toe 42. A lip 48 is provided which is inserted into the jet orifice cap 14 to secure the jet body cap 12 therein.

Figure 5:
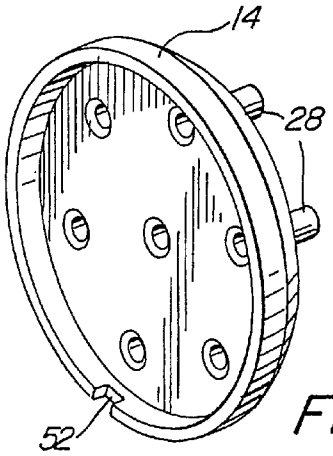
FIG. 5 is a perspective view of the jet orifice cap.

FIG. 5 illustrates the jet orifice cap 14 and its plurality of nozzles 28. The nozzles 28 are arranged in a generally circular pattern as shown, with the nozzles 28 aimed in a direction parallel to the axis 50 of the jet. The nozzles 28 are preferably molded in a unitary construction with the jet orifice cap 14, which may include a notch 52 along a circumferential edge which cooperates with a tab on the jet body cap (not shown) to align the two components.

Figure 6:
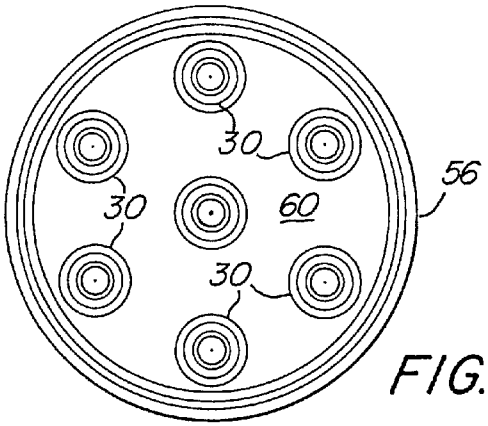
FIG. 6 is a front view of the jet body showing the nozzle pattern.
Figure 8:
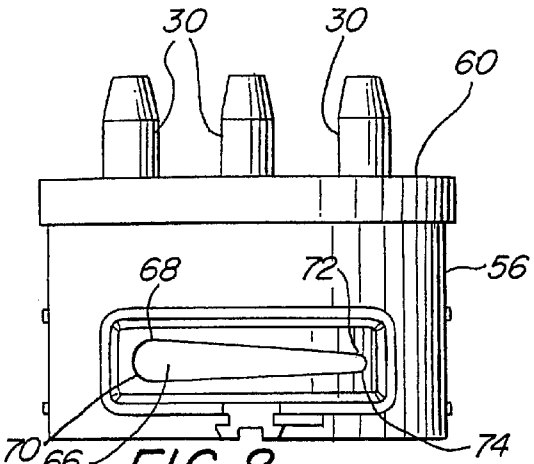
FIG. 8 is a side view of the jet body illustrating the air adjustment slot.
Figure 7:
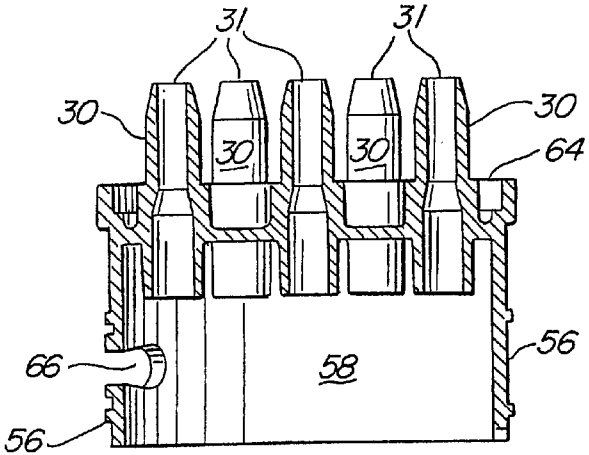
FIG. 7 is a cross-sectional view of the jet body of a preferred embodiment illustrating the chamber.

In FIGS. 6–8, the jet body 16 is illustrated in greater detail. A jet pattern of the preferred embodiment is shown comprising seven nozzles 30, six along a common circumference and one in the center. A cross-sectional view (FIG. 7) shows the cylindrical wall 56 defining a chamber 58 in the interior of the jet body 16. The nozzles 30 are of the same length and are shown protruding from an end 64 of the jet body 16 with the ends 31 of the nozzles 30 terminating in a common plane. A teardrop-shaped slot or air orifice 66 is located on the side of the jet body 16 in the cylindrical wall 56, and permits access to the chamber 58 of the jet body 16. The slot 66 narrows or tapers in the circumferential direction from a maximum width 68 at a first end 70 to a minimum width 72 at a second end 74. As will be described, when a supply of air is placed adjacent the slot 66, the rotation of the jet causes more air to enter the chamber 58 when the maximum width 68 of the slot 66 is adjacent the air supply, and when the jet is rotated away from this "maximum air intake" position the amount of air introduced into the chamber 58 decreases. Around the slot 66 is a groove which holds a sealing O-ring 78 to seal the jet body 16 when it is placed in the wall mounting 100.

Figure 10:
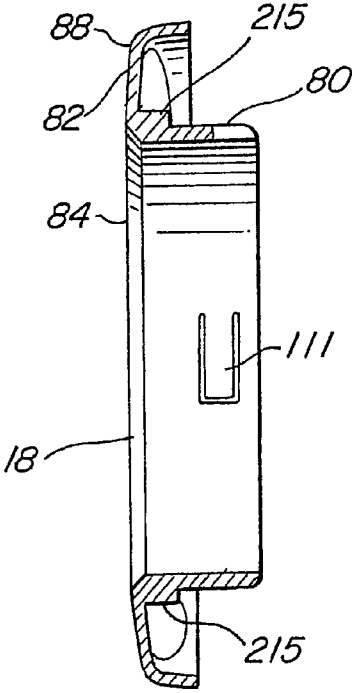
FIG. 10 is a cross sectional view of the face plate shown in FIG. 9.
Figure 9:
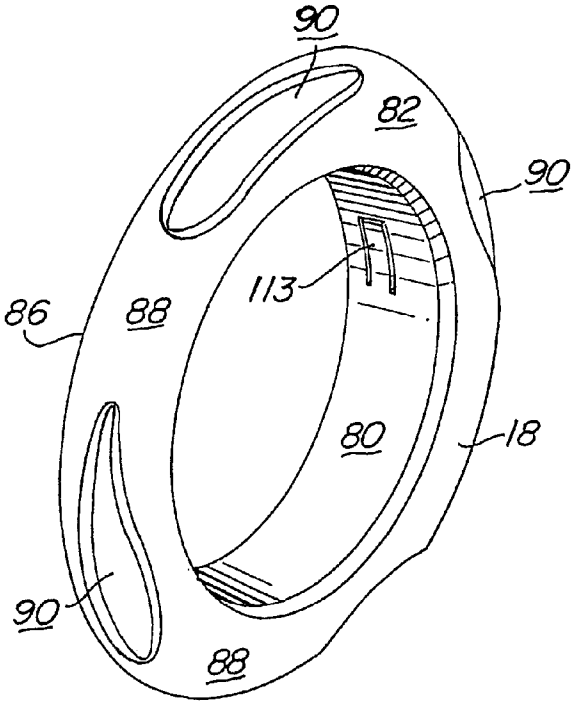
FIG. 9 is a perspective view of a face plate of the preferred embodiment.

In FIGS. 9 and 10 a face plate 18 is shown comprising a cylindrical portion 80 terminating in a beveled rim 82. The face plate 18 has an exit plane 84 and the rim 82 includes an outer surface 88, with beveled areas 90 for use in gripping the face plate 18. The cylindrical portion 80 is sized such that when the face plate 18 is rigidly mounted to the jet body 16 in its intended configuration (see FIG. 2), the exit plane 84 of the face plate 18 extends beyond the nozzle tips 31 to protect a user from contact with the nozzles 30. The beveled surfaces 90 improve the grip of the face plate 18, which is used to rotate the jet body within the mounting structure. A granular surface can be added to the face plate to further improve the gripping surface of the face plate 18, which is usually wet and slippery when in use.

Figure 11:
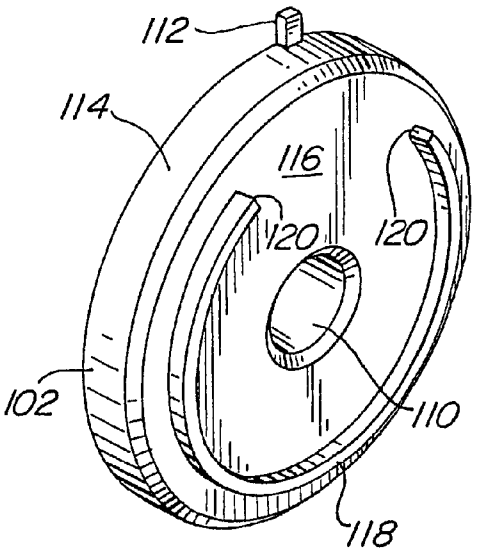
FIG. 11 is a perspective view of the rear wall mounting cap of a preferred embodiment.

In FIG. 11, the rear wall mounting cap 102 is illustrated. The rear wall mounting cap 102 fits into the rear wall housing and operates to secure the jet inside the housing. A tubular extension 110 is provided, which is sized to receive the tubular inlet 24 of the jet body cap 12 to protect the tubular inlet 24. The rear wall mounting cap 102 fits snugly into the rear wall housing 104 to close the housing. At the perimeter 114 of the rear wall mounting cap 102 is a tab 112 which projects radially from the perimeter 114. The tab 112 is used to align the rear wall mounting cap 102 within the rear wall mounting 104 using a notch 132 in the end of the rear wall mounting 104.

On the inner surface 116 of the rear wall mounting cap 102 is an arcuate ridge 118 which opposes the jet body cap 12 when the rear wall mounting cap 102 is in place in the rear wall housing 104 (see FIG. 1). The arcuate member 118 acts as a stop to limit the rotation of the jet 10 inside the mounting structure when the toe 42 of the jet body cap 12 is positioned between the ends 120 of the arcuate member 118. In this configuration, the jet is free to rotate between the ends 120 of the arcuate member 118 on the rear wall mounting cap 102, but cannot rotate outside of this range. When the tab 112 on the rear wall mounting cap 102 is inserted into the notch 132, the ends 120 of the arcuate member 118 are positioned to coincide with the maximum air intake position and the "no-air" intake position of the jet body 16.

Figure 12:
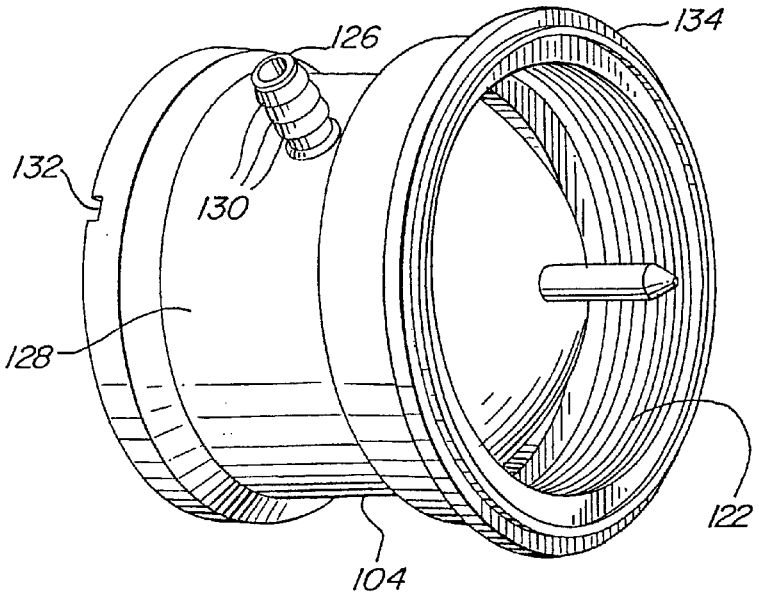
FIG. 12 is a perspective view of a rear wall mounting of a preferred embodiment which includes a molded-in pressure test plug which is removed after test and is not present during normal operation.

In FIG. 12, the rear wall mounting 104 is shown as a cylindrical, open housing including internal threads 122 and a circumferential lip 134 at one end. At the rear of the mounting is the notch 132 which cooperates with the tab 112 on the rear wall mounting cap 102 to specify the relative positions of the mounting 104 and the cap 102. A hollow stem 126 protrudes from a central outer wall 128 of the rearwall housing 104 and provides a channel by which air can be introduced into the interior of the rear wall housing 104. The hollow stem 126 is sized to be inserted into an air hose (not shown) and is provided with conical ridges 130 which facilitate such insertion and resist detachment of the air hose.

The stem 126 is positioned adjacent the slot 66 of the jet body when the jet 10 is housed inside the rear wall mounting 104 such that air passing through the stem is introduced directly into the chamber 58 of the jet body 16 via the slot 66. As noted, the amount of air introduced is dependent upon the width of the slot directly adjacent the stem 126 such that the user can control the amount of air injected into a stream of water by rotating the position of the jet 10 in between the maximum air intake position and the "no-air" intake position defined concurrently by the ends 64,70 of the slot 66 and the ends 120 of the arcuate member 118 on the rear wall mounting cap 102. The "no-air" intake position is de fined by rotating the slot 66 just beyond the stem 126 such that no air is introduced into the chamber 58. Because the slot 66 gradually increases in width as the jet 10 is rotated towards the maximum air intake position, allowing a greater amount of air into the chamber 58, a user can control the amount of air which is introduced into the stream of water; in effect enabling the user to control the intensity of the hydrotherapy.

In FIG. 1, the front wall mounting 108 is shown having a cylindrical portion 136 with external threads 138 which mate with the internal threads of the rear wall mounting 104 to fasten the two components together. When placed in an opening of the wall of a spa sized to receive the (cylindrical member 136, the rotation of the front wall mounting 108 into the rear wall mounting 104 on respective sides of the wall 92 secures the jet 10 in place. The circumferential lip 140 on the front wall mounting 108 bears against the wall 92 on the front side 96 while the circumferential lip 134 on the rear wall mounting 104 bears against the wall 92 on the rear side 98. In this manner it can be seen that the jet 10, while mounted in the housing structure 100, can be secured to a wall of a spa or other hydrotherapeutic reservoir for operation thereat. An O-ring 106 is preferably located between the rear wall mounting 104 and the wall 92 to reduce the possibility of leakage.

The extent to which the adjustable body assembly 10 extends into the mounting structure 100 is determined by the length of the assembly 10 and the abutment between a front face of the front wall mounting 108 and a plurality of stops 215 (FIG. 10) formed on the face plate 18. Surfaces facilitating rotation of the adjustable body assembly 10 within the wall fitting assembly 11 are provided by semicircular raised bearing surfaces 185, 187 on the jet body 16 and by the interface between the circular inner rim 101 of the front wall mounting 108 and the cylindrical portion 80 of the face plate 18.

The cylindrical portion 80 of face plate 18 further may include first and second circumferential tabs 111, 113 projecting therefrom and diametrically disposed from one another. These tabs 111, 113 have a spring bias to them which allows them to be depressed and thereafter snap behind an inner ridge of the front face of the front wall mounting 108, thereby retaining the face plate 18 in position, rotatably mounted within the front wall mounting 108. Each tab 111, 113 may further include a chamfered leading edge to assist in depressing the respective tab 111, 112 as it contacts the front face of the front wall mounting 108 during insertion into the interior of the front wall mounting 108. Such chamfered leading edges make the face plate 18 easier to insert than it is to remove.

The operation of the Gatling-type jet 10 will now be described. When the jet 10 is placed in the housing structure 100, the stem of the rear wall mounting 126 is aligned with the slot 66 of the jet body 16. The toe 42 of the jet body cap 12 is at the same time disposed between the ends 120 of the arcuate member 118 of the rear wall mounting cap 102 to limit the rotation of the jet between the maximum air intake position and the "no-air" intake position. The tubular inlet 24 of the jet 10 is connected to a source of pressurized, heated water which enters the jet and immediately fills the reservoir 26 between the jet body cap 12 and the jet orifice cap 14. The reservoir 26 quickly fills and the building fluid pressure generated therein is released by the expulsion of the water through the nozzles 28 on the jet orifice cap 14. Each nozzle 28 directs a stream of the heated water across the chamber 58 within the jet body 16, and into a corresponding second nozzle 30 positioned directly opposite the first nozzle 28. Each stream then passes through its second nozzle 30 and out of the jet 10, and as it passes through the second nozzle 30 a venturi effect is created by the second nozzle 30. The relationship of the size of the nozzles 28 to the size of the nozzles 30, both in orifice diameter and axial spacing, is responsible for generation of the venturi effect.

The user may also rotate the jet 10 using the beveled surface 90 of the face plate 18, which is exposed to the exterior of the spa wall. Rotation of the face plate 18 is limited to the range between the maximum air intake position corresponding to the alignment of the air supply channeled through the stem 126 of the rear wall mounting 104 and the slot 66 of the jet body 16 at its maximum width 70, and the "no-air" intake position corresponding to an alignment with the stem just beyond the slot. By selecting any position along this range, the user can control the amount of air introduced into the chamber 58 and therefore the intensity of the hydrotherapy effect.

Figure 13:
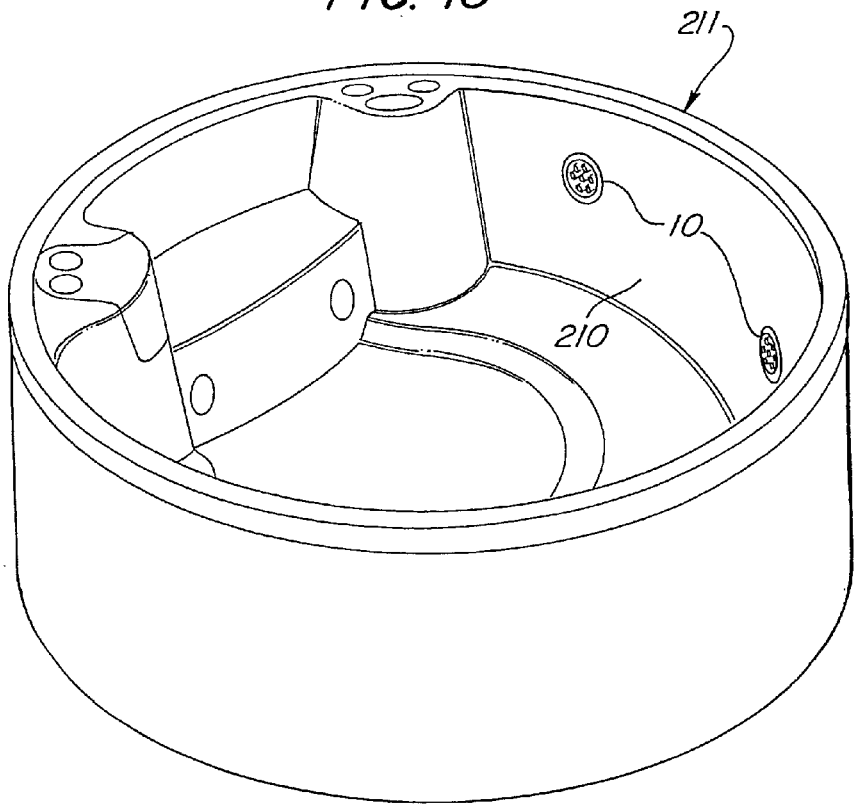
FIG. 13 illustrates a water discharge jet according to the preferred embodiment in place in the wall of a fluid reservoir or spa.

It will be understood that the embodiment described herein are merely exemplary and that a person skilled in the art may make many variations and modifications without departing from the spirit and scope of the invention. Such modifications include, but are not limited to variation in the number and positioning of the nozzles 28, 30. Various numbers of Gatling jets may be placed in various locations of various fluid reservoirs such as spas, tubs, whirlpools, and the like. In FIG. 13, two Gatling jets 10 are shown mounted in the inner wall 210 of a fluid reservoir or spa shell 211. All such variations and modifications are intended to be included within the scope of the invention as defined in the appended claims.

What is claimed is:

1. Hydrotherapy apparatus comprising:

a spa having an inner wall; and a fluid discharge jet sealably mounted in said inner wall, said jet consisting of seven nozzles, six of said nozzles being arrayed in a circle about a seventh nozzle located at the center of said circle, each nozzle having an inlet and a protruding barrel-shaped discharge end, each barrel of each nozzle further being shaped identically to the others and fixed in position parallel to the barrel of the others and recessed so as to lie entirely within an outer rim of said jet, said jet further having a single water inlet disposed behind the inlets of said nozzles, and a single air inlet.

2. Hydrotherapy apparatus comprising:

a spa having an inner wall; and a fluid discharge jet sealably mounted in said inner wall, said jet having a plurality of protruding fluid discharge nozzles, a single water inlet, and a single air inlet and wherein said plurality of fluid discharge nozzles consists of seven nozzles, six of said nozzles being arrayed in a circle about a seventh nozzle located at the center of said circle.

3. The apparatus of claim 2 wherein said jet further comprises a housing and a bezel component mounted for manual rotation with respect to said housing, said bezel component being manually rotatable after said jet has been sealably mounted in said wall, said bezel component having a hollow cylindrical central interior opening into which said seven discharge nozzles each extend and beyond which said seven discharge nozzles do not extend.

4. The apparatus of claim 3 further including means for causing said seven nozzles to rotate when said bezel is rotated.

5. The apparatus of claim 4 wherein said means for causing comprises:

a mounting surface behind said nozzles from which said nozzles protrude, said surface being molded together with said nozzles, said single water inlet being located behind said surface.

6. The apparatus of claim 5 wherein said mounting surface is fixed with respect to said bezel and rotates therewith.

7. Hydrotherapy apparatus comprising:

a spa shell having an inner wall;

a fluid discharge jet sealably mounted in said inner wall, said jet including a housing having a single water inlet, a single air inlet and a discharge nozzle array consisting of seven nozzles, each nozzle protruding from an integrally molded support portion, six of said nozzles being arrayed in a circle about a seventh nozzle located at the center of said circle;

a bezel component mounted for manual rotation with respect to said housing and being manually rotatable at all times after installation of said jet; and means for fixing said bezel component with respect to said support portion so as to cause said seven nozzles to rotate together with said bezel.

8. The apparatus of claim 7 wherein said means for fixing comprises a rigid attachment between said support portion and said bezel component.

9. The apparatus of claim 7 wherein said integrally molded support portion has a circular outer contour.

10. The apparatus of claim 9 further including means for adjusting the amount of air flow through said single air inlet in response to rotation of said bezel component.

11. The apparatus of claim 7 further including means for adjusting the amount of air flow through said single air inlet in response to rotation of said bezel component.

* * * * *